United States Patent [19]

Oswald

[11] 4,122,654

[45] Oct. 31, 1978

[54] TWIST FRAME CONTROL METHOD AND APPARATUS

[75] Inventor: Leo A. Oswald, Huntingdon, Pa.

[73] Assignee: Owens-Corning Fiberglas Corporation, Toledo, Ohio

[21] Appl. No.: 817,760

[22] Filed: Jul. 21, 1977

[51] Int. Cl.[2] ..... D01H 1/36; D01H 13/32

[52] U.S. Cl. ..... 57/54; 57/80; 57/99; 57/156

[58] Field of Search ..... 57/34 R, 54, 78, 80, 57/99, 156

[56] References Cited

U.S. PATENT DOCUMENTS

| | | | |
|---|---|---|---|
| 3,124,925 | 3/1964 | Kennedy et al. | 57/54 |
| 3,138,339 | 6/1964 | Jones, Sr. | 57/54 X |
| 3,336,739 | 8/1967 | Sanders | 57/54 |
| 3,462,935 | 8/1969 | Brauwer | 57/54 |
| 4,026,096 | 5/1977 | Stuart | 57/54 |

*Primary Examiner*—Charles Gorenstein

*Attorney, Agent, or Firm*—Ronald C. Hudgens; Philip R. Cloutier; Ted C. Gillespie

[57] ABSTRACT

A twister apparatus and method in which filamentary material is wound onto rotating bobbins are provided. A guide rail reciprocates within a range for distributing the filamentary material onto the bobbins, and the guide rail range itself is reciprocated along the height of the bobbins to distribute the filamentary material over a plurality of portions of the bobbins. Means for measuring the yardage of the filamentary material onto the bobbins is provided. Means responsive to a predetermined yardage for determining the presence of the guide rail within one of a plurality of predetermined portions of the bobbins is provided. There is also provided means for discontinuing the movement of the guide rail at a preselected position within the range of reciprocation of the guide rail.

8 Claims, 3 Drawing Figures

TWIST FRAME CONTROL METHOD AND APPARATUS

This invention pertains to a twist frame useful for winding and twisting filamentary materials onto a plurality of rotating bobbins. More particularly this invention relates to the positioning of a guide rail with respect to the bobbins for doffing purposes.

In a typical twist frame, a plurality of bobbins is mounted for rotation and a guide rail reciprocates longitudinally of each bobbin to distribute the filamentary material along the height of the bobbin as the bobbin spins. In such a twisting operation, the guide rail reciprocates within a range of vertical movement. In some twisting operations the range of reciprocation of this guide only covers a portion of the height of the bobbins, and the range of reciprocation is displaced along the height of the bobbins in order that the guide rail distribute the filamentary material over a plurality of portions of the bobbins.

In a twisting operation, it is desirable to provide for the stopping of the ring rail at the bottom of its stroke upon the cessation of the twisting operation. With the ring rail positioned at the bottom of its stroke, the removal of the bobbins from their spindles is facilitated, and there is reduced chance for the soiling of the yarn package by contact with the twist frame apparatus. U.S. Pat. No. 3,169,361 to White discloses a method and apparatus for halting the operation of the twisting such that the guide rail is positioned at the bottom of its stroke.

With the advent of the twist frame in which the guide is reciprocated within a range, and in which the range itself is displaced along the height of the bobbins there has been a need for apparatus which could sense the position of the range and the position of the guide rail within the range and accomplish the stopping of the twist frame with the ring rail not only at a given point in the range or at the bottom point of the range, but also in a range which is near the bottom of the bobbin.

Additionally, with the advent of the building motion of twist frames in which the guide rail is reciprocated in a range and in which the range itself is displaced over a plurality of portions of the bobbins, larger and larger packages of filamentary material can be produced on the bobbins. This has considerably lengthened the amount of time required to build the packages on the bobbins, and in some twisting operations, package building takes up to 2 or 3 days or more. In conventional twisting operations such as that disclosed in the patent to White, apparatus for stopping the ring rail in the desired bottom position is positioned so as to be constantly monitoring the position of the ring rail. The state of being mechanically activated during the entire building of the package on the bobbin can lead to premature wear of the sensing and braking mechanisms of the conventional twisting apparatus.

According to this invention, there is provided an improved twister method and apparatus of the type in which filamentary material is wound onto bobbins, and in which the yardage of filamentary material wound onto the bobbins is measured, and in which a guide rail reciprocates within a range of reciprocation over a portion of the height of said bobbins, and in which the range of reciprocation is displaced along the height of the bobbins in order that the guide rail distribute the filamentary material over a plurality of portions of the bobbins; means responsive to the measurement of a predetermined yardage of filamentary material activates a first detecting means; the first detecting means detects the presence of the guide rail within a predetermined portion of the height of the bobbins; means responsive to the detection of the guide rail by the first detecting means activates a second detecting means; the second detecting means detects the presence of the guide rail at a preselected position within the range or reciprocation of the guide rail; and means responsive to the detection of the guide rail by the second detecting means discontinues the movement of the guide rail. The apparatus can be adapted so that the guide rail is stopped at the bottom of its range of reciprocation. The apparatus can be adapted so that the predetermined portion of the bobbin is near the bottom of the bobbin. The first and second detecting means can be proximity sensors.

The method and apparatus of this invention are particularly suitable for the packaging of strands of glass fibers.

Figure 1:
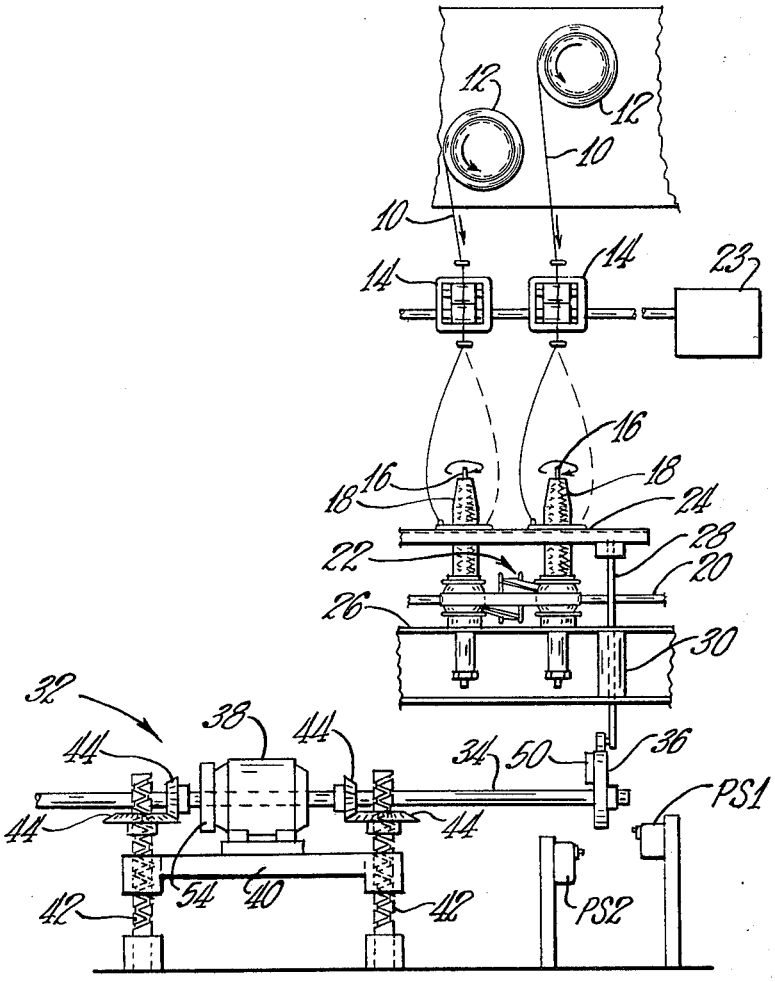
FIG. 1 is a front elevation view of a portion of a textile strand twisting apparatus employing the apparatus of this invention.
Figure 2:
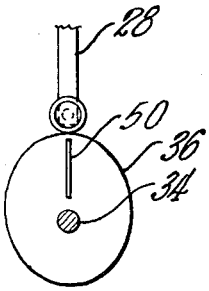
FIG. 2 is a side elevation view of the cam apparatus of FIG. 1.
Figure 3:
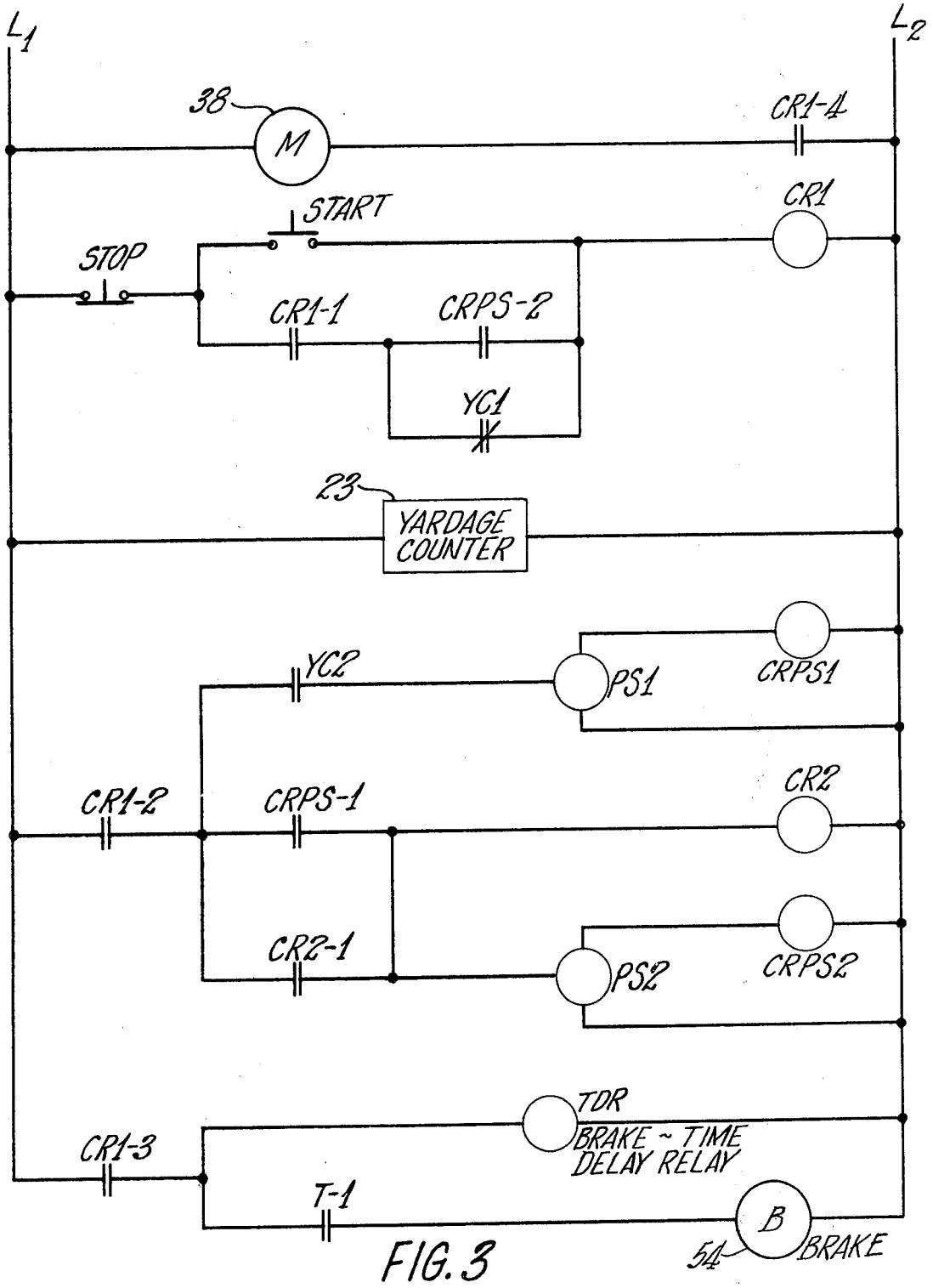
FIG. 3 is a schematic view of the control circuitry for carrying out the principles of this invention.

Referring now to FIGS. 1 and 2 there is shown a twister apparatus in which filamentary material 10 is removed from supply packages 12 by means of conventional driving means 14. The filamentary material is wound onto bobbins 16 to form packages 18. The bobbins are mounted for rotation and are driven by the rotation of driving shaft member 20 in conjunction with a conventional belt drive system 22. The shaft can be powered by a conventional motor, not shown.

Mounted in conjunction with the conventional driving means for driving the filamentary material from the packages to the guide rail is yardage counter 23, which can be of the conventional type. The yardage counter can be initially zeroed and thenceforth can count the yardage of the filamentary material wound onto the bobbins. A yardage counter which can be used according to the principles of this invention is the Durant series 1000 predetermining counter.

Guide rail 24 is mounted for reciprocation in the vertical direction. The guide rail guides the filamentary material onto the package, and the reciprocation of the guide rail creates a helical winding pattern on the bobbin. The guide rail is mounted on frame 26 for vertical reciprocation by means of guide rail support member 28 which is moved vertically in housing 30.

The reciprocal motion of the guide rail is that of reciprocation within a range over a portion of the height of the bobbins. The range itself is displaced along the height of the bobbins in order that the guide rail distribute the filamentary material over a plurality of portions of the bobbins. The reciprocation of the guide rail and the displacement of the range of reciprocation are accomplished by means of reciprocation apparatus 32. Mounted on rotating cam shaft 34 is cam 36, upon which the guide rail support member rides. Therefore the guide rail support member reciprocates vertically with the rotation of the cam. This reciprocation of the guide rail support member reciprocates the guide rail. The cam shaft is driven by motor 38 which can be a conventional motor. The motor is mounted on a frame 40 and the frame is mounted on two driving shafts 42. The shafts are mounted for rotation and are adapted so that the rotation of the shafts causes the motor frame, and thus the motor also, to move vertically. This can be accomplished by such conventional means as a double helical pattern or track on the surface of the driving shafts. Thus, as the driving shafts are rotated, the motor frame, the motor, the cam shaft, and the cam will all reciprocate vertically. Conventional gears 44 can be mounted on the cam shaft and the driving shafts to provide for the driving by the cam shaft of the driving shafts. The driving shafts are preferably driven at a speed slower than the cam shaft.

Proximity sensor PS1 can be positioned near the cam shaft for the detection of the presence of the cam shaft. PS1 is normally inactive during the operation of the twist frame. During the operation of the twist frame, the cam shaft can be adapted so that only when it is in the lower portion of its vertical displacement, and only when PS1 is activiated, will PS1 sense the presence of the cam shaft. In conjunction with each position of the cam shaft, in its vertical movement, there is associated a portion of the height of the bobbin over which the guide rail reciprocates. PS1 can be positioned to be sensitive to the cam shaft only when the guide rail is within a predetermined portion of the bobbin.

Mounted on the cam is trigger member 50, as shown more clearly in FIG. 2. The trigger member rotates with the cam as the cam rotates. Proximity sensor PS2, which is normally inactive, is mounted to be adjacent the cam during certain positions of the cam within its reciprocation. When PS2 has been activated and when the trigger member mounted on the cam is sufficiently close to PS2, then PS2 will sense this and will produce a signal accordingly in a conventional manner. A proximity sensor which can be utilized for either PS1 or PS2 according to the principles of this invention is one produced by Microswitch, Model FYC-D16-C3-2. In operation, the rotation of the cam and the trigger member will position the trigger member in proximity with PS2 periodically, and the guide rail will be positioned at the preselected position in its range at the time the trigger member is in proximity with PS2. Thus, PS2 can determine when the guide rail is in a preselected position within one of several ranges.

Mounted on the motor frame is brake 54. The brake is activated by PS2 upon the sensing of the trigger member. Upon activation, the brake serves to stop the rotation of the cam shaft and bring about the consequent cessation of the reciprocation of the guide rail. The brake can be adapted with a brake time delay relay which acts to provide a time delay between the time the brake is activated by PS2 and the time at which the brake begins to stop the motion of the cam shaft. For example, after the brake is activated by PS2 there may be a five second time delay between the signal and the actual application of the brake. The purpose for the delay is to allow for adjustment of the exact stopping position of the ring rail. A suitable time delay relay which can be used for this purpose is a Potter Brumfield relay.

In a typical sequence of a twisting cycle, the opertion begins by the activation of a start switch, which closes a circuit and activates control relay CR1. The activation of control relay CR1 closes contacts CR1-1, CR1-2, and CR1-4. Also contact CR1-3, which is normally closed, is opened. The closing of contact CR1-4 energizes the motor. It is to be understood that the voltage supplied to the motor can differ from that supplied other elements of the control apparatus. The twist frame then runs through so much of the packaging cycle as is desired, and the yardage counter counts or measures the yardage of filamentary material wound onto the bobbins. When the yardage counter senses a sufficient or predetermined yardage of filamentary material wound onto the bobbins, control relay YC1, which is normally closed, will be opened, and contact YC2 will be closed. The closing of contact YC2 will activate proximity sensor PS1, which will sense the position of the guide rail and provide a signal when the guide rail is within a predetermined portion of the height of the bobbins. There can be a plurality of ranges which are sufficiently low for the effective stopping of the guide rail in a position suitable for effective package removal, and proximity sensor PS1 will sense the presence of the guide rail within one of that plurality of preselected ranges. The sensing by PS1 that the guide rail is within one of the plurality of preselected ranges activates control relay CRPS1. The activation of control relay CRPS1 closes contact CRPS-1 which in turn activates control relay CR2 and proximity sensor PS2. The activation of control relay CR2 closes contact CR2-1. Proximity sensor PS2, which is now active, will sense the position of the trigger member on the cam to determine when the cam reaches a predetermined point in its revolution i.e., when the guide rail is at a predetermined point within its range of reciprocation. Upon the sensing of the trigger member, proximity sensor PS2 will activate control relay CRPS2. The activation of control relay CRPS2 opens normally closed contact CRPS-2, which opens the circuit through control relay CR1. The deactivation of control relay CR1 opens contacts CR1-1, CR1-2, and CR1-4, and closes contact CR1-3. The opening of contact CR1-4 shuts off the power to the motor. The closing of contact CR1-3 activates the brake time delay relay. The brake time delay relay closes contact T-1 after a time period which is a preselected time period from the time of activation of the brake time delay relay. Closing of contact T-1 operates the brake and brings the reciprocation of the guide rail to a halt.

The various modifications of the above described embodiment of the invention will be apparent to those skilled in the art, and it is to be understood that such modifications can be made without departing from the scope of the invention.

What is claimed is:

1. An improved twister apparatus of the type in which filamentary material is wound onto bobbins, and in which the yardage of filamentary material wound onto the bobbins is measured, and in which a guide rail reciprocates within a range of reciprocation over a portion of the height of said bobbins, and in which the range of reciprocation is reciprocated along the height of the bobbins in order that said guide rail distribute said filamentary material over a plurality of portions of said bobbins, the improvement comprising:

(a) first detecting means for detecting the presence of said guide rail within a predetermined portion of said bobbins;

(b) means responsive to the measurement of a predetermined yardage of filamentary material for activating said first detecting means;

(c) second detecting means for detecting the presence of said guide rail at a preselected position within the range of reciprocation of said guide rail;

(d) means responsive to the detection of said guide rail by said first detecting means for activating said second detecting means; and, (e) means responsive to the detection of said guide rail by said second detecting means for discontinuing the movement of said guide rail.

2. The apparatus of claim 1 in which said means responsive to said second detecting means is adapted to discontinue the movement of said guide rail at the bottom of the range of the guide rail.

3. The apparatus of claim 2 in which said predetermined portion of said bobbins is near the bottom of said bobbins.

4. The apparatus of claim 3 in which said first detecting means comprises a proximity sensor.

5. The apparatus of claim 4 in which said second detecting means comprises a proximity sensor.

6. An improved twister method of the type in which filamentary material is wound onto bobbins, and in which the yardage of filamentary material wound onto the bobbins is measured, and in which a guide rail reciprocates within a range of reciprocation over a portion of the height of said bobbins, and in which the range of reciprocation is reciprocated along the height of the bobbins in order that said guide rail distribute said filamentary material over a plurality of portions of said bobbins, the improvement comprising:

(a) activating a first detector means in response to a predetermined yardage of filamentary material;

(b) detecting with said first detecting means the presence of said guide rail within a predetermined portion of said bobbins;

(c) activating a second detecting means in response to the detecting of said guide rail;

(d) detecting with said second detecting means the presence of said guide rail at a preselected position within the range of reciprocation of said guide rail; and, (e) discontinuing the movement of said guide rail in response to the detection of said guide rail by said second detecting means.

7. The method of claim 6 in which said predetermined portion is near the bottom of said bobbins.

8. The method of claim 7 in which said preselected position within the range of reciprocation is near the bottom of the range of reciprocation.

* * * * *